US007523909B1

(12) United States Patent
Liebers et al.

(10) Patent No.: US 7,523,909 B1
(45) Date of Patent: Apr. 28, 2009

(54) DISPLAY HANGER FOR NON-PRESCRIPTION READING GLASSES AND CASE

(75) Inventors: Steven B. Liebers, Norristown, PA (US); Kurt Shenk, Lansdale, PA (US)

(73) Assignee: Diversified Products, Inc., Collegeville, PA (US)

( * ) Notice: Subject to any disclaimer, the term of this patent is extended or adjusted under 35 U.S.C. 154(b) by 0 days.

(21) Appl. No.: 11/924,226

(22) Filed: Oct. 25, 2007

(51) Int. Cl.
*A47F 5/00* (2006.01)

(52) U.S. Cl. ..... 248/309.1; 248/902; 206/5

(58) Field of Classification Search ..... 248/309.1, 248/902, 225.11, 225.21, 224.8, 690, 300, 248/301; 206/5, 6, 806, 486; 24/3.3; 351/158; D9/457, 722
See application file for complete search history.

(56) References Cited

U.S. PATENT DOCUMENTS

| | | | | | |
|---|---|---|---|---|---|
| 646,638 | A | | 4/1900 | Cutler | |
| 1,333,765 | A | | 3/1920 | Moore | |
| 2,656,917 | A | * | 10/1953 | Hollis | 206/5 |
| 3,136,409 | A | | 6/1964 | Schumann | |
| 3,329,386 | A | | 7/1967 | Rosen | |
| 3,370,733 | A | | 2/1968 | Giesler | |
| 3,819,033 | A | * | 6/1974 | Hueber | 206/5 |
| 3,884,443 | A | | 5/1975 | McMaster | |
| 3,885,667 | A | * | 5/1975 | Spiegel et al. | 206/478 |
| 4,132,309 | A | | 1/1979 | Shaylor | |
| 4,257,522 | A | | 3/1981 | Thorneburg | |
| D289,016 | S | | 3/1987 | Campbell | |
| D308,080 | S | | 5/1990 | Sachs | |
| 5,000,410 | A | * | 3/1991 | Beavers | 248/205.3 |
| 5,002,187 | A | | 3/1991 | Rysner et al. | |
| 5,044,773 | A | | 9/1991 | Harms et al. | |
| 5,046,696 | A | | 9/1991 | Lee | |
| 5,129,617 | A | * | 7/1992 | MacWilliamson | 248/690 |
| 5,144,345 | A | * | 9/1992 | Nyman | 351/158 |
| 5,340,074 | A | * | 8/1994 | Porcaro et al. | 248/309.1 |
| D357,278 | S | | 4/1995 | Turney | |
| 5,423,505 | A | * | 6/1995 | David | 248/214 |
| 5,477,964 | A | * | 12/1995 | Hart | 206/349 |
| 5,484,056 | A | | 1/1996 | Wood | |

(Continued)

OTHER PUBLICATIONS

Five (5) photographs (identified 1 through 5) of the "Slim-Line Ultra Thin Readers" packaging.

*Primary Examiner*—Anita M King
(74) *Attorney, Agent, or Firm*—Caesar, Rivise, Bernstein, Cohen & Pokotilow, Ltd.

(57) ABSTRACT

A hanger system for holding glasses and a case includes a hanger of a thin web having a main body having top, bottom and two side edges and a top aperture for receiving a hook. A flexible strip is connected to the main body at a hinge point where the strip flexes away from the main body. The strip is connected to an arm of the glasses. A portion of the main body slidably engages the case, wherein the main body is located substantially inside the case and the flexible strip is flexed away from the main body at the hinge point and located outside the case. An upper edge of the case is located at the hinge point such that the main body is inside and the strip is outside the case. The pair of arms opens to accommodate a user trying on the glasses with the case attached.

6 Claims, 4 Drawing Sheets

U.S. PATENT DOCUMENTS

| | | | | | |
|---|---|---|---|---|---|
| 5,559,567 | A | * | 9/1996 | Kolton et al. | 351/158 |
| 5,636,821 | A | * | 6/1997 | Davies | 248/300 |
| D381,046 | S | | 7/1997 | Hiers et al. | |
| 5,672,238 | A | | 9/1997 | Samuelson | |
| 5,699,907 | A | | 12/1997 | Langenstuck | |
| 5,699,990 | A | * | 12/1997 | Seach | 248/309.1 |
| 5,743,403 | A | * | 4/1998 | Crysdale | 206/482 |
| 5,791,608 | A | | 8/1998 | Nielsen et al. | |
| 5,823,503 | A | | 10/1998 | Wasserman | |
| 5,913,416 | A | | 6/1999 | Rothan | |
| RE36,258 | E | | 7/1999 | Coward et al. | |
| 6,032,793 | A | | 3/2000 | Oakley | |
| D431,460 | S | | 10/2000 | Nichol | |
| 6,575,295 | B2 | | 6/2003 | Mayfield | |
| 6,581,760 | B1 | * | 6/2003 | Robertson | 206/5 |
| D478,510 | S | | 8/2003 | Kumakura | |
| 6,648,132 | B1 | | 11/2003 | Smouha | |
| D497,800 | S | | 11/2004 | Trettin | |
| 6,827,210 | B2 | | 12/2004 | Chen | |
| 7,055,680 | B2 | | 6/2006 | Liebers | |
| D527,634 | S | | 9/2006 | Liebers | |
| D545,675 | S | | 7/2007 | Liebers | |
| 2002/0189955 | A1 | | 12/2002 | Waters | |

* cited by examiner

FIG.3
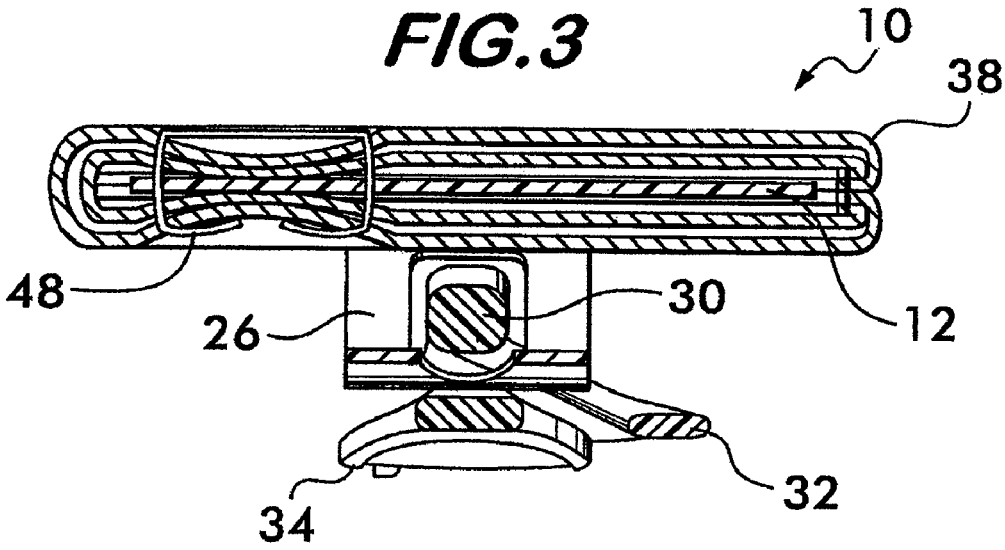
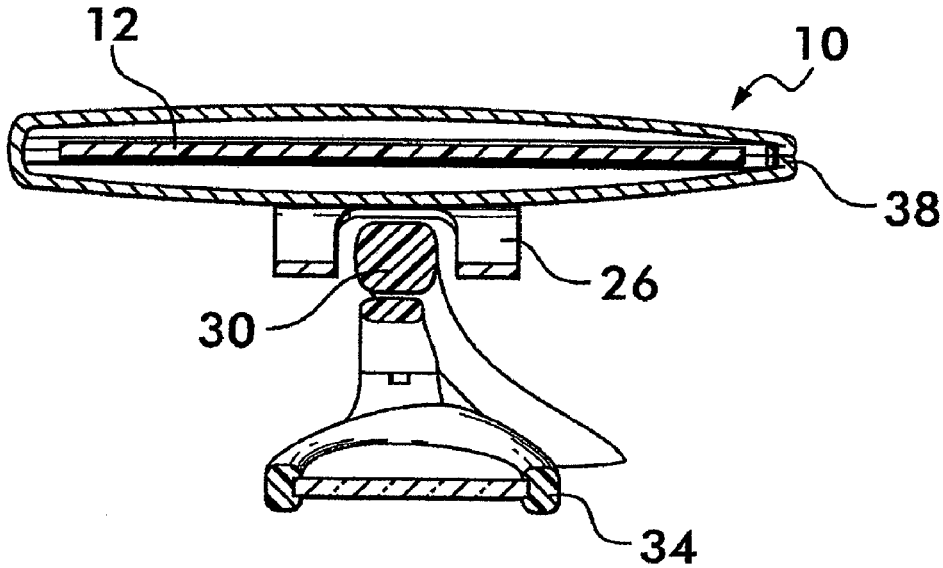
FIG.4

DISPLAY HANGER FOR NON-PRESCRIPTION READING GLASSES AND CASE

BACKGROUND OF THE INVENTION

This invention relates to a display hanger for non-prescription reading glasses and an accompanying case for use on a hanging type display stand.

Various display hangers exist in the prior art for hanging various articles, such as hand tools and the like. For example, U.S. Pat. No. 5,484,056 (Wood) teaches a display hanger for suspending an article such as a screwdriver. A special elastomeric grommet is used to hang the tool.

Additionally, U.S. Pat. No. 3,884,443 (McMaster) teaches a pressure-sensitive hanger for small articles such as merchandise packages, wall packages and the like that can be hung on display rods or hooks. This invention is directed to a universal hanger that is applied with adhesive to a small item. Here, a means to prevent peeling of the hanger from the product to which it is secured is included.

Various eyeglass holders are also known. For example, U.S. Pat. No. 5,046,696 (Lee) teaches a holder for eyeglasses which accepts a temple portion of an eyeglass frame for supporting eyeglasses in a vertical position. The holder may be mounted, for example, in an automobile, boat or convenient location in a home. The design includes a planar first member and a second member integral to the first which protrudes outwardly. An opening between the first and second members accepts the temple of the eyeglass frame. An adhesive is applied to a surface of the first member for adhesion of the device to another surface.

U.S. Pat. Nos. D545,675 (Liebers), D527,634 (Liebers), and 7,055,680 (Liebers) disclose a hanger for a case holding a pair of glasses. The hanger includes a web of flexible material having an elongate main body portion having an upper end and a lower end and a pair of tabs extending from the lower end of the main body portion. The tabs encircle the case. An aperture adjacent to the upper end of the main body portion receives a support for hanging the hanger, thereby holding the case.

However, to this point, a very simple and inexpensive hanger for a glasses and a glasses case has not been known that allows a user to try on the glasses such that the glasses remain attached to the case by the hanger such that a the matched pair of glasses and case always remain together, thereby avoiding loss, mismatched glasses and cases, etc.

All references cited herein are incorporated herein by reference in their entireties.

BRIEF SUMMARY OF THE INVENTION

A hanger system for holding a pair of glasses having a frame having a pair of arms, and a case is provided which includes a hanger constructed from a thin web. The hanger includes a main body having a top edge, a bottom edge and two side edges, and a flexible strip integral to the thin web. The flexible strip is located generally midway between the two side edges and is connected to the main body at a hinge point. The flexible strip is adapted to flex away from the main body at the hinge point. The flexible strip is connected to an arm of the pair of glasses. A portion of the main body slidably engages the case, wherein the main body is located substantially inside the case and the flexible strip is flexed away from the main body at the hinge point and is located outside the case. An upper edge of the case is located generally at the hinge point. The pair of arms of the frame opens to accommodate a user trying on the pair of glasses with the case remaining attached to the pair of glasses by the hanger.

The flexible strip preferably has an upper aperture and a lower aperture for receiving one of the pair of arms. Preferably, the case is attached to the main body of the hanger by a fastener, such as a staple. A top aperture may be provided for receiving a hook, located adjacent to the top edge and generally midway between the two side edges. The case may be a bag constructed from a flexible material.

A hanger for holding a pair of glasses having a frame having a pair of arms and a case is also provided, wherein the hanger is a thin web having a main body having a top edge, a bottom edge and two side edges. A flexible strip is integral to the thin web and is located generally midway between the two side edges and is connected to the main body at a hinge point. The flexible strip is adapted to flex away from the main body at the hinge point, and is adapted to attach to an arm of the pair of glasses. A portion of the main body is adapted to slidably engage the case. The main body is located substantially inside the case and the flexible strip is flexed away from the main body at the hinge point and located outside the case. An upper edge of the case is adapted to be located generally at the hinge point;

Preferably, the flexible strip has an upper aperture and a lower aperture for receiving one of the pair of arms. Preferably, a top aperture for receiving a hook, located adjacent to the top edge and generally midway between the two side edges, is provided.

BRIEF DESCRIPTION OF SEVERAL VIEWS OF THE DRAWINGS

The invention will be described in conjunction with the following drawings in which like reference numerals designate like elements and wherein:

FIG. 3 is a top, cross-sectional view of the display hanger system for non-prescription reading glasses and case of FIG. 1, taken substantially along lines 3-3 of FIG. 2, shown having the glasses and case attached thereto;

FIG. 4 is a top, cross-sectional view of the display hanger system for non-prescription reading glasses and case of FIG. 1, taken substantially along lines 4-4 of FIG. 2, shown having the glasses and case attached thereto;

DETAILED DESCRIPTION OF THE INVENTION

Figure 1:
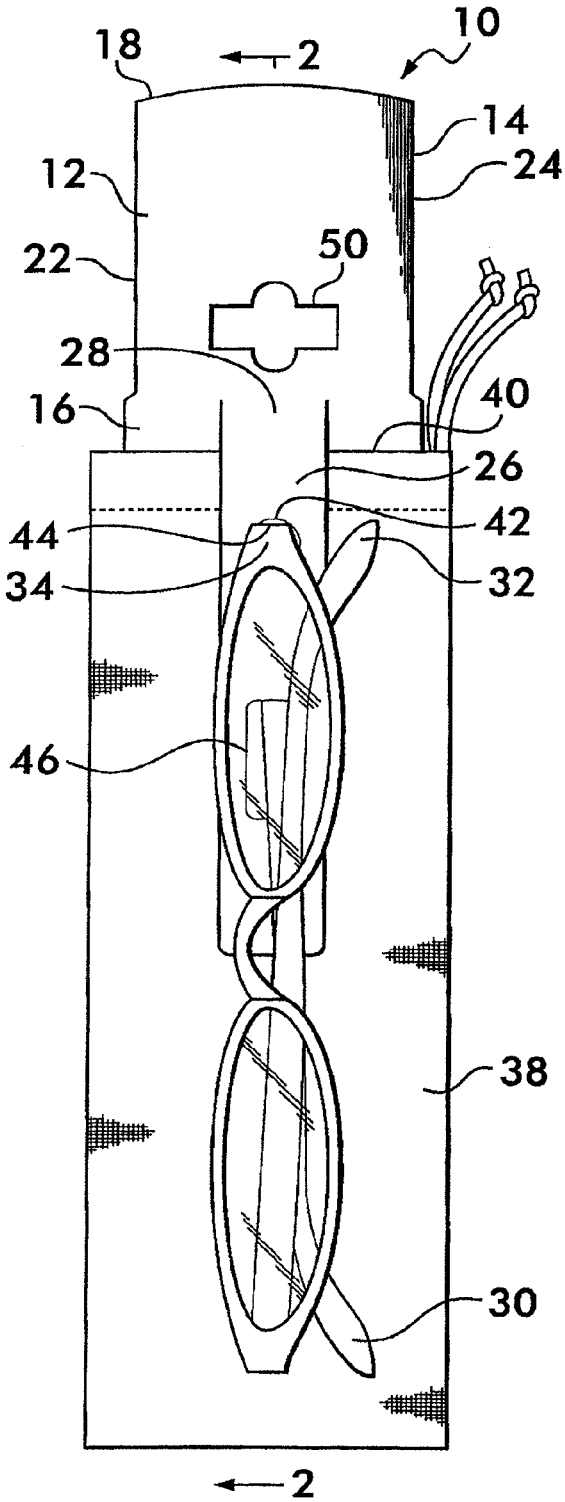
FIG. 1 is a front, elevation view of a display hanger system for non-prescription reading glasses and case in accordance with a preferred embodiment of the present invention, shown having the glasses and case attached thereto.

The invention will be illustrated in more detail with reference to the following embodiment, but it should be understood that the present invention is not deemed to be limited thereto.

Referring now to the drawings, wherein like part numbers refer to like elements throughout the several views, there is shown in FIGS. 1-5, a hanger system 10 for holding a pair of glasses and a case in accordance with a preferred embodiment of the present invention. The hanger system 10 includes a hanger 12 constructed from a thin web 14 of, for example, polyvinylchloride. Paper, cardboard or nearly any other suitable thin flexible material may be suitable.

Figure 5:
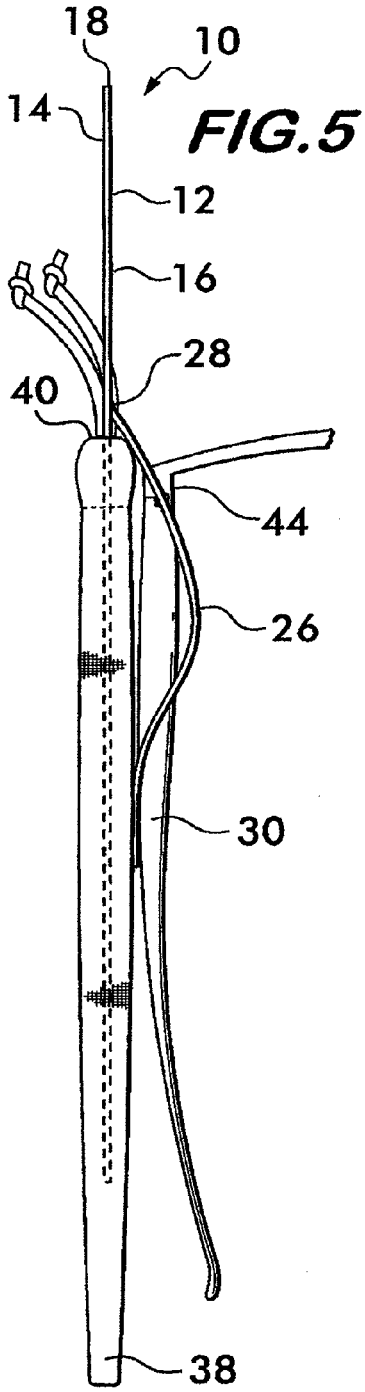
FIG. 5 is a side, elevation view of the display hanger system for non-prescription reading glasses of FIG. 1, shown having the glasses and case attached thereto.
Figure 6:
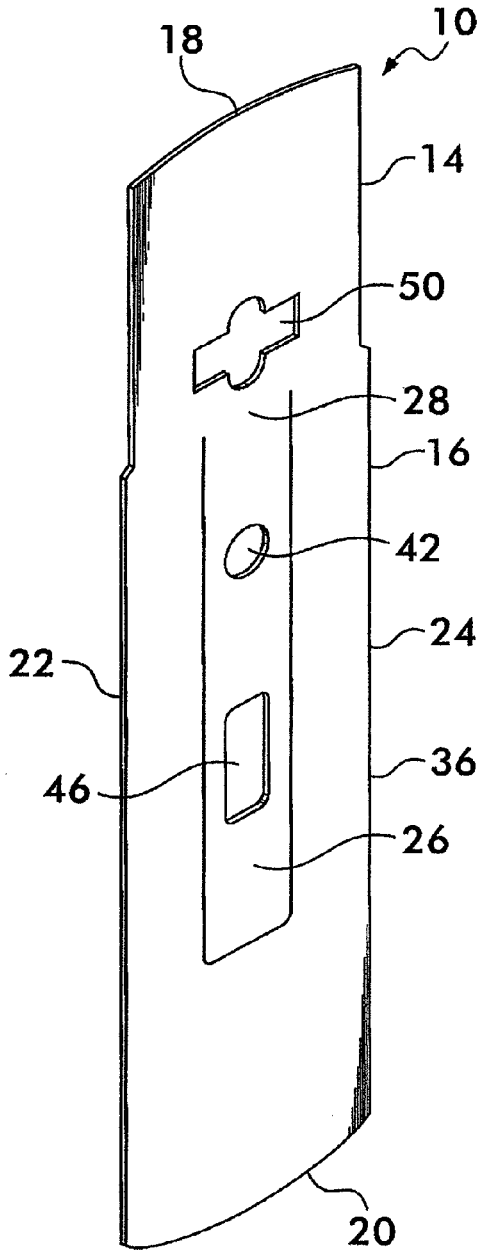
FIG. 6 is an isometric view of a display hanger of the display hanger system for non-prescription reading glasses of FIG. 1.

As can be seen in FIGS. 1-5 and more clearly in FIG. 6 (which shows the hanger 12 itself), the hanger 12 has a main body 16 having a top edge 18, a bottom edge 20 and two side edges 22, 24. A flexible strip 26, integral to the thin web 14, is provided which is located generally midway between the two side edges 22, 24 and is connected to the main body 16 at a hinge point 28. It is noted that the natural flex of the flat web 14 provides the hinge point 28. No actual mechanical hinge point or even a score line or the like is necessary. The flexible strip 26 is capable of flexing away from the main body 16 at the hinge point 28, as best shown, for example, in FIGS. 2 and 5. The flexible strip 26 is connected to one of the two temple arms 30, 32 of the pair of glasses 34, as will be described in further detail below.

Figure 2:
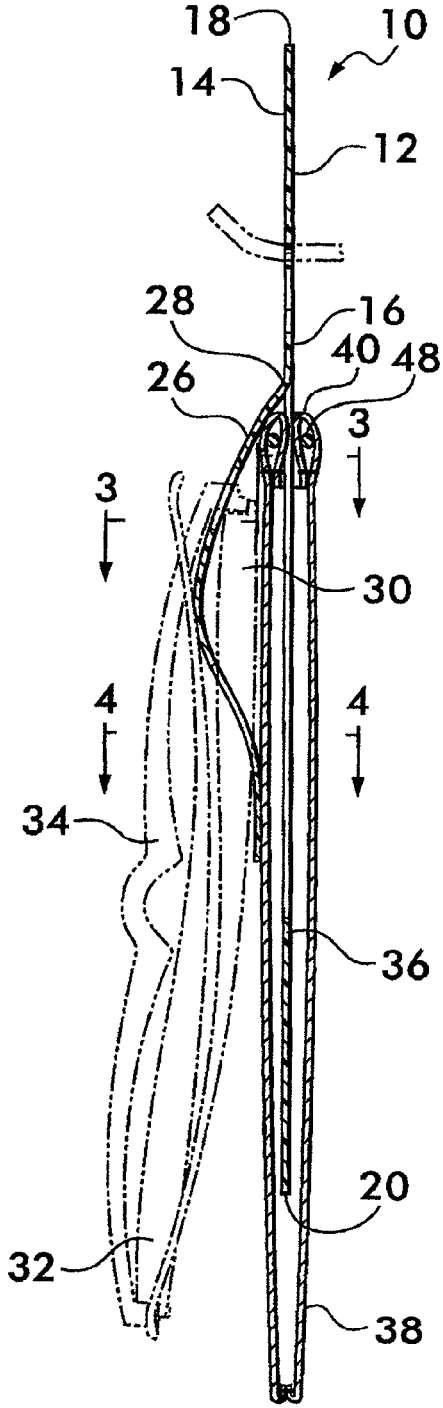
FIG. 2 is side, cross-sectional view of the display hanger system for non-prescription reading glasses and case of FIG. 1, taken substantially along lines 2-2 of FIG. 1, shown having the glasses and case attached thereto.

As can be seen in FIGS. 1-5, a portion 36 of the main body 16 of the hanger 12 is slid into the case 38. In this preferred embodiment, the case 38 is a soft cloth bag, constructed from a fabric and having a drawstring. However, it is within the desired scope of the present invention to use other types of cases and cases of different materials, for example, molded plastic, formed metal, flexible vinyl, and the like. As stated above, the portion 36 of the main body 16 is located substantially inside the case 38. However, the flexible strip 26 is flexed away from the main body 16 at the hinge point 28 such that the flexible strip 26 is located substantially outside of the case 38. As best seen in FIGS. 2 and 5, an upper edge 40 of the case 38 is located generally at the hinge point 28.

Figure 7:
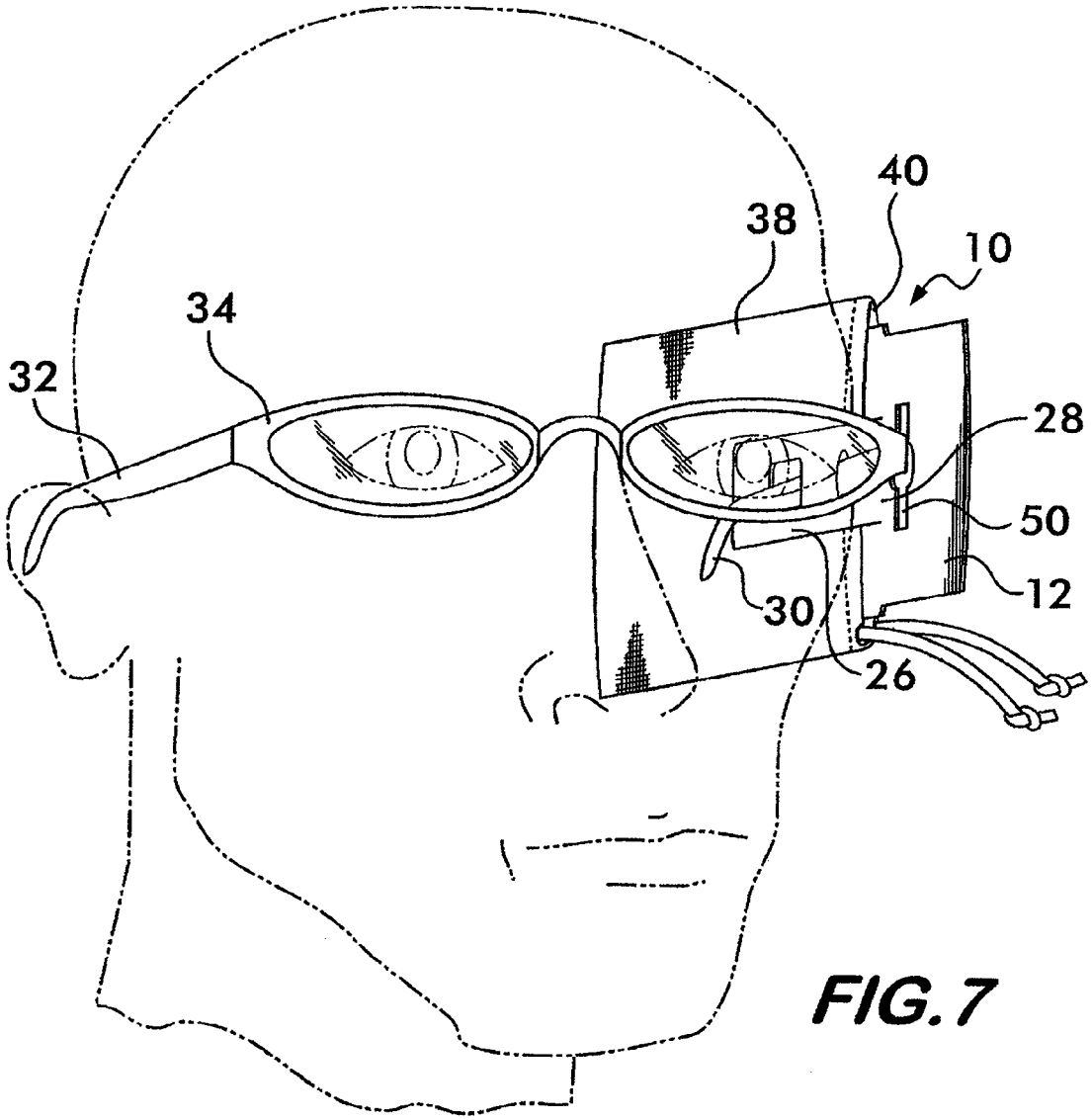
FIG. 7 is an isometric view of the display hanger system for non-prescription reading glasses of FIG. 1, shown in an open condition for testing by a user.

In use, as best seen in FIG. 7, a user walks up to a display having numerous styles and powers of non-prescription reading glasses using the hanger system for holding a pair of glasses and a case 10 of the present invention. The user selects a desired power and style and removes the hanger system 10 from the rack. The flexible strip 26 allows the user to open the temple arms 32 and try on the glasses with the case 38 and hanger 12 remaining attached to the non-prescription reading glasses 34.

The glasses 34 may be attached to the flexible strip 26 of the hanger 12 by any suitable means known in the art. In the preferred embodiment shown in the drawings, one of the arms 30 is weaved through two holes in the flexible strip 26. The arm 30 is first inserted through a preferably round aperture 30 and then threaded back through a rectangular aperture 46. See FIG. 6. The round aperture 42 is slid up until it meets the glasses hinge 44. See FIGS. 1, 2 and 5.

Preferably, the case 38 is held to the hanger 12 by a fastener such as a staple 48. However, other devices can be used to attach the case to the hanger (for example, even the drawstring 50 of the case 38 would operate effectively.

Preferably, a top aperture 50 for receiving a hook, located adjacent to the top edge 18 of the hanger, is provided. Preferably, this aperture 50 is located generally midway between the two side edges 22, 24 for proper balance.

While the invention has been described in detail and with reference to specific examples thereof, it will be apparent to one skilled in the art that various changes and modifications can be made therein without departing from the spirit and scope thereof.

What is claimed is:

1. A hanger system and a pair of glasses having a frame having a pair of arms, and a case, comprising:

(a) a hanger constructed from a thin web, said hanger comprising:

(i) a main body having a top edge, a bottom edge and two side edges; and (ii) a flexible strip integral to the thin web, the flexible strip located generally midway between the two side edges and connected to the main body at a hinge point, the flexible strip adapted to flex away from the main body at the hinge point, the flexible strip connected to an arm of the pair of glasses;

(b) a portion of the main body slidably engaging the case, wherein the main body is located substantially inside the case and the flexible strip is flexed away from the main body at the hinge point and located outside the case, an upper edge of the case located generally at the hinge point;

whereby the pair of arms of the frame is openable to accommodate a user trying on the pair of glasses with the case remaining attached to the pair of glasses by the hanger.

2. The hanger system and pair of glasses and a case of claim 1, wherein the flexible strip has an upper aperture and a lower aperture for receiving one of the pair of arms.

3. The hanger system and pair of glasses and a case of claim 1, wherein the case is attached to the main body of the hanger by a fastener.

4. The hanger system and pair of glasses and a case of claim 3, wherein the fastener is a staple.

5. The hanger system and pair of glasses and a case of claim 1, including a top aperture for receiving a hook, located adjacent to the top edge and generally midway between the two side edges.

6. The hanger system and pair of glasses and a case of claim 1, wherein the case comprises a bag constructed from a flexible material.

* * * * *